United States Patent [19]

Sorg

[11] Patent Number: 4,951,420

[45] Date of Patent: Aug. 28, 1990

[54] POLISHING APPARATUS

[76] Inventor: Volkmar R. Sorg, 10610 Salisbury Drive, Surrey, British Columbua, Canada, V3R 6Z3

[21] Appl. No.: 353,134

[22] Filed: May 16, 1989

[51] Int. Cl.[5] ..... B24B 27/04; B24B 27/027

[52] U.S. Cl. ..... 51/58; 51/68; 51/166 TS; 74/25

[58] Field of Search ..... 51/58, 57, 68, 67, 170 TL, 51/166 TS; 74/25

[56] References Cited

U.S. PATENT DOCUMENTS

| | | | |
|---|---|---|---|
| 741,519 | 10/1903 | Mahaffy | 51/170 TL |
| 1,089,456 | 3/1914 | Beam | 51/57 |
| 1,679,884 | 8/1928 | Thomas | 51/170 TL |
| 2,210,733 | 8/1940 | Schmid et al. | 51/170 TL |
| 3,739,534 | 6/1973 | Fuller | 51/67 |

*Primary Examiner*—Robert A. Rose

*Attorney, Agent, or Firm*—Townsend and Townsend

[57] ABSTRACT

A polishing apparatus comprising a support base on which is mounted a power source to drive a swash plate, and an extension member connecting the power source and the swash plate to a remote polishing member. The polishing member comprises a gripping portion for the operator and a receiving member adapted to accept a polishing stone. The extension member comprises a hollow outer tube having a movable inner core to transmit the reciprocating motion of the swash plate to the receiving member of the remote polishing member in order to reciprocate the polishing stone at high speed.

10 Claims, 2 Drawing Sheets

POLISHING APPARATUS

FIELD OF THE INVENTION

This invention relates to an apparatus for polishing surfaces, particularly for polishing the interior surface of molds for the production of articles of manufacture.

DESCRIPTION OF THE PRIOR ART

Prior art examples of polishing machines include U.S. Pat. No. 3,427,751 to Lanman disclosing a polishing machine for die finishing and U.S. Pat. No. 1,758,953 to Krause disclosing an apparatus for polishing dies used in wire drawing that uses a reciprocating polishing rod. In addition, devices for cleaning molds are shown in U.S. Pat. Nos. 3,248,752 to Wagner and 3,059,305 to Brozdowicz.

The prior art polishing devices comprise apparatus of considerable bulk and complexity.

SUMMARY OF THE INVENTION

The present invention is a polishing apparatus comprising:

a support base;

a power source to drive reciprocating means mounted to said support base;

means mounted to said support base to vary the amplitude of reciprocation of said reciprocating means;

an extension member connecting the power source and the reciprocating means to a remote polishing member comprising a gripping portion and a receiving member adapted to accept a polishing stone, said extension member comprising a hollow outer tube having a movable inner core to transmit the reciprocating motion of said reciprocating means to the receiving member of said remote polishing member.

The present invention is a polishing apparatus that is compact and relatively simple in structure and can be easily controlled by an operator. The polishing apparatus is light weight and portable and affords the user a great deal of control when polishing a surface.

DESCRIPTION OF THE DRAWINGS

Embodiments of the present invention are illustrated, merely by way of example, in the following drawings in which.

DESCRIPTION OF THE PREFERRED EMBODIMENTS

The drawings show various embodiments of the polishing device of the present invention for use in polishing mold 35 mounted on work support 36.

Figure 1:
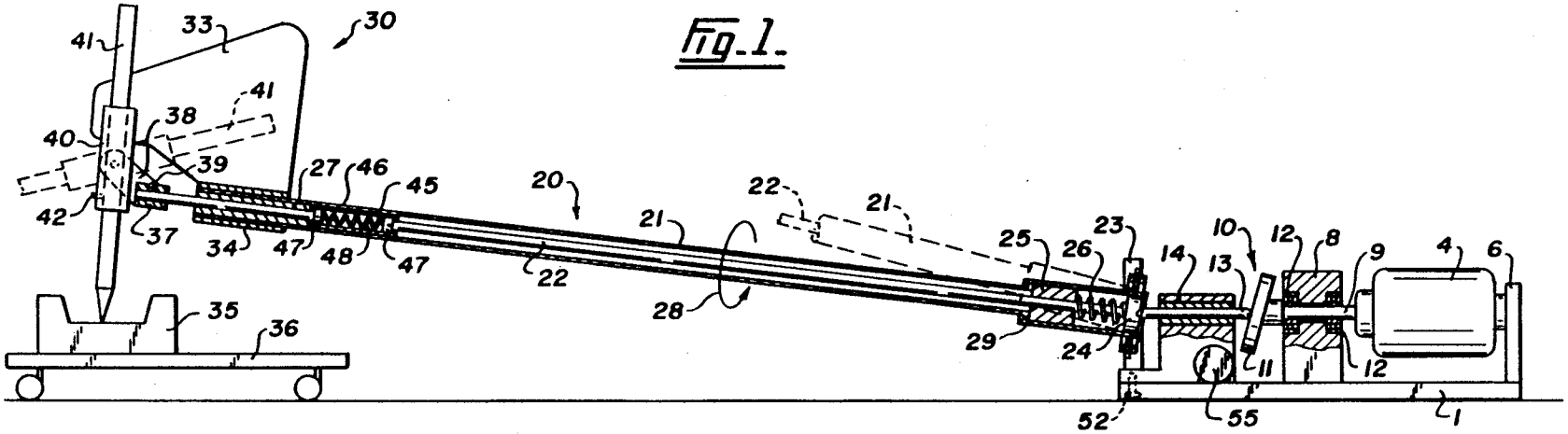
FIG. 1 is an elevation view of a first embodiment of the present invention.

Referring to FIG. 1, there is shown a first embodiment of the present invention comprising a support base 1 with attached power source 4 and reciprocating means 10, extension member 20 and polishing member 30.

In the embodiment of FIG. 1, power source 4 consists of a variable speed electric motor firmly mounted to support base 1. Electric motor 4 is supported between post 6 and bearing housing 8 through which the drive shaft 9 of the motor extends. Bearings 12 rotatably support drive shaft 9.

Reciprocating means 10 comprises a conventional swash plate 11 that is attached to the end of drive shaft 9 so as to rotate with the shaft in combination with a longitudinal member 13 which is slidably supported within a pivotable housing 14. Longitudinal member 13 extends between swash plate 11 and the movable inner core of extension member 20.

Figure 2:
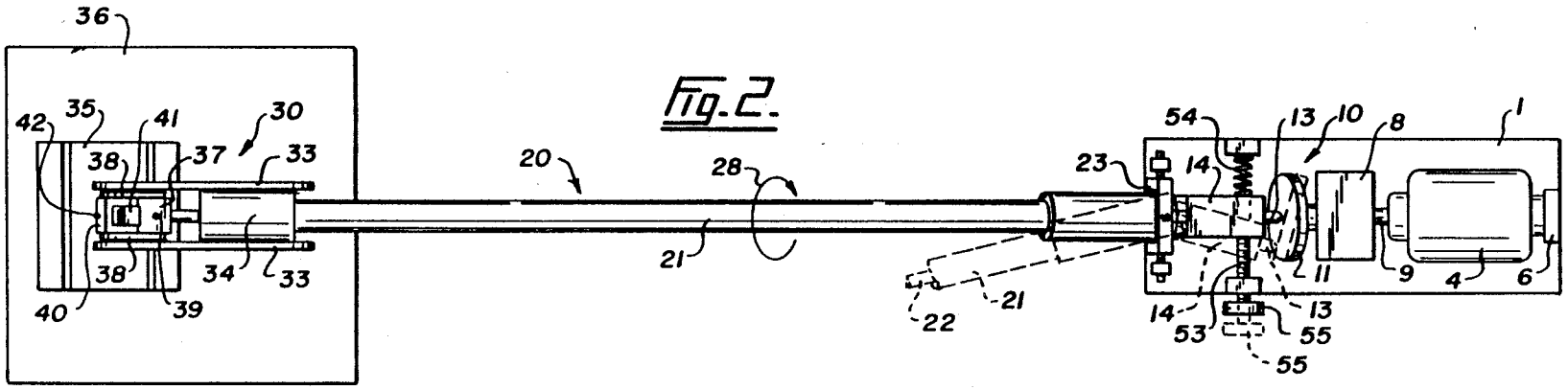
FIG. 2 is a plan view of the first embodiment of FIG. 1.

In the embodiments of FIGS. 1 and 2, extension member 20 comprises a rigid hollow tube 21 having a rigid movable inner core 22. Extension member 20 is attached to support base 1 by means of a conventional universal joint connector 23 which allows for free vertical and horizontal movement of the extension member as shown by the dotted lines in FIGS. 1 and 2. The end of the extension member connected to supported base 1 has an enlarged diameter portion which houses a piston head 24 that is rigidly attached to movable inner core 22 and bushing 25 to slidably support inner core 22. Disposed between piston head 24 and bushing 25 is spring 26 to bias movable inner core 22 and piston head 24 against longitudinal member 13. As longitudinal member 13 slides freely within housing 14, longitudinal member 13 is forced into contact with the surface of swash plate 11 by spring 26.

At the point that extension member 20 meets the enlarged diameter portion, there is provided a rotatable joint 29 to allow the extension member to rotate axially as indicated by arrow 28.

Extension member 20 terminates at polishing member 30. At this end, movable inner core 22 extends past the end of hollow tube 21 supported by bushing 27. Polishing member 30 has a gripping portion comprised of two spaced parallel handle plates 33 connected by a housing 34 which fits over the end of hollow tube 21. Located between parallel plates 33 and attached to the protruding end of movable inner core 22 is housing 37 having spaced parallel arms 38. Housing 37 is located on inner core 22 by set screw 39. Between arms 38 is pivotally supported receiving member 40 comprising a tubular member for holding a conventional elongated polishing stone 41 therein using set screw 42 to clamp the polishing stone in place. Polishing stone receiving member 40 can be pivoted to various angles as shown by the dashed lines in FIG. 1.

Along its length, movable inner core 22 is interrupted by a shock absorbing member 45. This member comprises an outer housing 46 to join the interrupted ends 47 of movable inner core 22. Outer housing 46 is freely movable with the inner core within hollow tube 21. Inside housing 46 the interrupted ends of the inner core are joined by a resilient member comprising spring 48. Each interrupted end 47 of the inner core is free to move within housing 46 so that any shock load exerted on the movable inner core during normal polishing operations will tend to be absorbed by the spring 48 of the shock absorbing member 45. The main function of the shock absorbing member is to eliminate breaking of the polishing stone 41 by insulating it from shocks as for example may occur if the polishing stone were to suddenly hit a hard surface or slip on an edge of the article being polished.

Figure 3:
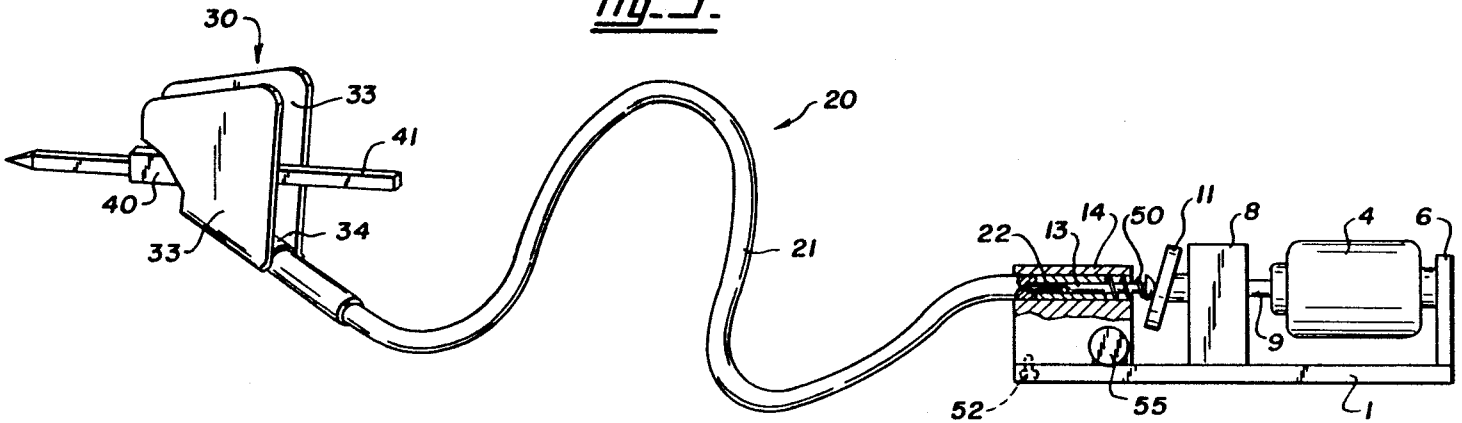
FIG. 3 is an elevation view of a second embodiment of the present invention.

FIG. 3 illustrates a flexible extension member embodiment of the present invention in which analogous parts to the embodiment of FIGS. 1 and 2 are identically numbered. Extension member 20 comprises a flexible sheath 21 within which a flexible core 22 is linearly reciprocated. Flexible core 22 may comprise a steel wire. Extension member 20 is connected to polishing member 30 by a rigid section of tubing about which housing 34 supporting handle plates 33 is mounted. Within this rigid section is a resilient member (not shown) to tension the flexible steel wire and eliminate play in the flexible sheath 21.

In the embodiment of FIG. 3, reciprocating means 10 is simplified in that extension member 20 can be attached directly to pivotable housing 14 and longitudinal member 13 is directly connected to flexible inner core 22. Spring 50 serves to bias the rounded and enlarged end of longitudinal member 13 against swash plate 11. It will be appreciated that the flexible extension member 20 can also be attached to the universal joint connector 23 of the previous embodiment.

In operation, the electric motor 4 is used to rotate swash plate 11 with a resulting reciprocating motion of the inner core 22 of the extension member causing high speed reciprocation of the polishing stone. The operator grasps handle plates 33 in order to control the path of the polishing stone.

Varying the speed of electric motor 4 allows for different polishing speeds of polishing stone 41. The present invention also provides means for varying the amplitude of the polishing stone's polishing motion. This amplitude variation is accomplished by virtue of the pivotable nature of housing 14 with respect to support base 1. Housing 14 is attached to base 1 by means of a screw 52 extending upwardly through the base 1 and into the housing to allow pivoting about the screw. As seen in FIG. 2, the angle of pivotable housing 14 with respect to the rotation axis of swash plate 11 is controlled by threaded screw 53 and spring 54 which act against opposite sides of the housing. Spring 54 applies a force causing housing 14 to pivot about screw 52 and against screw 54. By rotating the knurled head 55 of screw 53, the angle of housing 14 can be adjusted so that longitudinal member 13 contacts a different annular path on the surface of swash plate 11 thereby changing the stroke of member 13 and the resulting amplitude of motion of polishing stone 41. Such an adjustment can be made even while motor 4 is running.

The present invention provides a compact and light weight apparatus that is excellent for high speed, high precision polishing particularly of the interior surfaces of molds for articles of manufacture. The flexible extension member embodiment of the present invention allows the user great flexibility in positioning the polishing member. The rigid extension member embodiment of the present invention gives the user good control over the polishing area as the extension member is movable in all directions according to polishing needs. Operator fatigue is reduced as the weight of the polishing member does not have to be completely supported by the user.

I claim:

1. A polishing apparatus comprising:

a support base;

a power source to drive reciprocating means mounted to said support base;

means mounted to said support base to vary the amplitude of reciprocation of said reciprocating means;

an extension member mounted to said support base by a universal joint and connecting the reciprocating means to a remote polishing member comprising a gripping portion and a receiving member adapted to accept a polishing stone, said extension member comprising a rigid hollow outer tube having a movable inner core to transmit the reciprocating motion of said reciprocating means to the receiving member of said remote polishing member.

2. A polishing apparatus as claimed in claim 1 in which said reciprocating means comprises a swash plate driven by said power source, said swash plate causing a driven member to reciprocate within a housing to drive the movable inner core of said extension member.

3. A polishing apparatus as claimed in claim 2 in which said means for varying the amplitude of reciprocation of said reciprocating means comprises a pivotable housing mounted to said support base that supports said driven member acted on by said swash plate whereby pivoting of said housing with respect to the rotational axis of said swash plate causes said driven member to contact a different annular path on the surface of said swash plate thereby varying the linear reciprocating distance of said driven member.

4. A polishing apparatus as claimed in claim 3 in which said pivotable housing is biased by resilient means against an adjusting means to vary the pivoting angle of said housing.

5. A polishing apparatus as claimed in claim 4 in which said resilient means is a spring.

6. A polishing apparatus as claimed in claim 4 in which said adjusting means comprises a threaded screw having a knurled head for manual rotation of the screw shank which abuts against said pivotable housing.

7. A polishing apparatus as claimed in claim 1 in which said power source comprises a variable speed electric motor.

8. A polishing apparatus as claimed in claim 1 in which said movable inner core of said extension member is interrupted by resilient means mounted co-linearly with said inner core in order to absorb shock loads applied to said movable inner core.

9. A polishing apparatus as claimed in claim 1 in which said movable inner core is supported by bushings at each end within said hollow outer tube.

10. A polishing apparatus as claimed in claim 1 in which said movable inner core is biased by spring means toward said reciprocating means.

* * * * *